US011117770B2

(12) United States Patent
Sugawara et al.

(10) Patent No.: US 11,117,770 B2
(45) Date of Patent: Sep. 14, 2021

(54) SHEET STACKING APPARATUS, POST-PROCESSING APPARATUS, AND IMAGE FORMING SYSTEM

(71) Applicants: Hisayoshi Sugawara, Kanagawa (JP); Kei Sasaki, Kanagawa (JP); Junya Suzuki, Kanagawa (JP); Koji Furuta, Kanagawa (JP); Yasuo Niikura, Kanagawa (JP); Kazuki Mishina, Kanagawa (JP); Kenji Hari, Kanagawa (JP); Yuuta Mori, Kanagawa (JP); Yuusuke Shibasaki, Kanagawa (JP)

(72) Inventors: Hisayoshi Sugawara, Kanagawa (JP); Kei Sasaki, Kanagawa (JP); Junya Suzuki, Kanagawa (JP); Koji Furuta, Kanagawa (JP); Yasuo Niikura, Kanagawa (JP); Kazuki Mishina, Kanagawa (JP); Kenji Hari, Kanagawa (JP); Yuuta Mori, Kanagawa (JP); Yuusuke Shibasaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/808,667

(22) Filed: Mar. 4, 2020

(65) Prior Publication Data

US 2020/0307936 A1 Oct. 1, 2020

(30) Foreign Application Priority Data

Mar. 28, 2019 (JP) ..... JP2019-062842

(51) Int. Cl.

| | |
|---|---|
| ***B65H 31/38*** | (2006.01) |
| ***B65H 9/16*** | (2006.01) |
| ***B65H 9/00*** | (2006.01) |

(52) U.S. Cl.

CPC ..... *B65H 9/166* (2013.01); *B65H 9/002* (2013.01); *B65H 9/004* (2013.01)

(58) Field of Classification Search

CPC ..... B65H 31/00; B65H 31/02; B65H 31/08; B65H 31/10; B65H 31/26; B65H 31/36;

(Continued)

(56) References Cited

U.S. PATENT DOCUMENTS 5,599,009 A * 2/1997 Mandel ..... H04N 1/32561 270/58.09
5,603,492 A * 2/1997 Mandel ..... B65H 39/10 270/58.09

(Continued)

FOREIGN PATENT DOCUMENTS

| | | |
|---|---|---|
| JP | 2002-167105 | 6/2002 |
| JP | 2008-037626 | 2/2008 |
| JP | 2009-062149 | 3/2009 |

*Primary Examiner* — Thomas A Morrison
(74) *Attorney, Agent, or Firm* — Harness, Dickey & Pierce, P.L.C.

(57) ABSTRACT

A sheet stacking apparatus includes an ejector, a stacker, a wall, and an upper surface detector. The ejector ejects a sheet, and the stacker stacks the sheet ejected from the ejector. The wall contacts a trailing end of the sheet ejected from the ejector in an ejection direction to align the sheet. The upper surface detector detects an upper surface on a trailing end side of the sheet stacked on the stacker in the ejection direction. When the sheet moves toward the wall, the upper surface detector moves from a home position in which the upper surface detector detects the upper surface of the sheet to a retracted position in which the upper surface detector does not contact the sheet moving toward the wall.

17 Claims, 10 Drawing Sheets

(58) Field of Classification Search
CPC ..... B65H 9/002; B65H 9/166; B65H 9/004; B65H 31/38
See application file for complete search history.

(56) References Cited

U.S. PATENT DOCUMENTS

| | | | | |
|---|---|---|---|---|
| 5,609,333 | A * | 3/1997 | Mandel | B65H 39/11 270/58.09 |
| 5,644,494 | A * | 7/1997 | Richardson | B65H 9/00 700/223 |
| 9,656,826 | B2 * | 5/2017 | Miyazaki | B65H 33/08 |
| 10,150,641 | B2 * | 12/2018 | Noso | B65H 37/04 |
| 2002/0063380 | A1 | 5/2002 | Tamura et al. | |
| 2007/0176357 | A1 | 8/2007 | Horio et al. | |
| 2009/0066003 | A1 | 3/2009 | Kunieda et al. | |
| 2009/0152792 | A1 | 6/2009 | Kato et al. | |
| 2012/0083400 | A1 | 4/2012 | Shibasaki et al. | |
| 2012/0086161 | A1 | 4/2012 | Nagasako et al. | |
| 2012/0153556 | A1 | 6/2012 | Sugiyama et al. | |
| 2012/0267846 | A1 | 10/2012 | Nakada et al. | |
| 2012/0282004 | A1 | 11/2012 | Furuhashi et al. | |
| 2012/0294695 | A1 | 11/2012 | Sasaki et al. | |
| 2013/0001848 | A1 | 1/2013 | Hidaka et al. | |
| 2013/0001849 | A1 | 1/2013 | Suzuki et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0228965 | A1 | 9/2013 | Hoshino et al. | |
| 2013/0236228 | A1 | 9/2013 | Nagasako et al. | |
| 2013/0264762 | A1 | 10/2013 | Matsushita et al. | |
| 2013/0270762 | A1 | 10/2013 | Saito et al. | |
| 2013/0270763 | A1 | 10/2013 | Furuhashi et al. | |
| 2013/0300050 | A1 | 11/2013 | Suzuki et al. | |
| 2014/0011656 | A1 | 1/2014 | Niikura et al. | |
| 2014/0062003 | A1 | 3/2014 | Niitsuma et al. | |
| 2014/0062005 | A1 | 3/2014 | Suzuki et al. | |
| 2014/0062016 | A1 | 3/2014 | Watanabe et al. | |
| 2014/0138896 | A1 | 5/2014 | Yoshida et al. | |
| 2014/0145395 | A1 | 5/2014 | Takano et al. | |
| 2014/0151951 | A1 | 6/2014 | Shibasaki et al. | |
| 2014/0159301 | A1 | 6/2014 | Suzuki et al. | |
| 2014/0203501 | A1 | 7/2014 | Hoshino et al. | |
| 2014/0219747 | A1 | 8/2014 | Takahashi et al. | |
| 2015/0003938 | A1 | 1/2015 | Morinaga et al. | |
| 2015/0028540 | A1 | 1/2015 | Shibasaki et al. | |
| 2015/0030414 | A1 | 1/2015 | Takahashi et al. | |
| 2015/0076759 | A1 | 3/2015 | Kosuge et al. | |
| 2015/0091246 | A1 | 4/2015 | Yoshida et al. | |
| 2015/0123342 | A1 | 5/2015 | Furuhashi et al. | |
| 2015/0166280 | A1 | 6/2015 | Hino et al. | |
| 2015/0225191 | A1 | 8/2015 | Niikura et al. | |
| 2015/0253716 | A1 | 9/2015 | Nagasako et al. | |
| 2015/0321872 | A1 | 11/2015 | Hari et al. | |
| 2015/0353315 | A1 | 12/2015 | Suzuki et al. | |
| 2015/0360899 | A1 | 12/2015 | Takahashi et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0185552 | A1 | 6/2016 | Hoshino et al. | |
| 2016/0264370 | A1 | 9/2016 | Okutsu et al. | |
| 2016/0272443 | A1 | 9/2016 | Seto et al. | |
| 2016/0340144 | A1 | 11/2016 | Sakano et al. | |
| 2016/0340145 | A1 | 11/2016 | Kunieda et al. | |
| 2016/0347572 | A1 * | 12/2016 | Noso | B65H 37/04 |
| 2016/0360053 | A1 | 12/2016 | Suzuki et al. | |
| 2017/0081140 | A1 | 3/2017 | Fukumoto et al. | |
| 2017/0174453 | A1 | 6/2017 | Akai et al. | |
| 2017/0174454 | A1 | 6/2017 | Matsuoka et al. | |
| 2017/0174458 | A1 | 6/2017 | Takano et al. | |
| 2017/0174462 | A1 | 6/2017 | Edo et al. | |
| 2017/0174465 | A1 | 6/2017 | Morinaga et al. | |
| 2017/0203935 | A1 | 7/2017 | Hari et al. | |
| 2017/0217239 | A1 | 8/2017 | Suzuki et al. | |
| 2017/0305706 | A1 | 10/2017 | Takahashi et al. | |
| 2018/0148286 | A1 | 5/2018 | Hari | |
| 2018/0251332 | A1 | 9/2018 | Hari et al. | |
| 2018/0259895 | A1 | 9/2018 | Shibasaki et al. | |
| 2018/0346265 | A1 | 12/2018 | Niikura | |

* cited by examiner

COMPARATIVE EXAMPLE

COMPARATIVE EXAMPLE

INITIAL POSITION

RETRACTED POSITION

COMPLETION OF RETRACTION

BEGINNING OF RETRACTION RELEASE

COMPLETION OF RETRACTION RELEASE

RETRACTED POSITION

HOME POSITION (UNCHANGED)

RETURN POSITION

SHEET STACKING APPARATUS, POST-PROCESSING APPARATUS, AND IMAGE FORMING SYSTEM

CROSS-REFERENCE TO RELATED APPLICATION

This patent application is based on and claims priority pursuant to 35 U.S.C. § 119 to Japanese Patent Application No. 2019-062842, filed on Mar. 28, 2019, in the Japan Patent Office, the entire disclosure of which is hereby incorporated by reference herein.

BACKGROUND

Technical Field

Exemplary aspects of the present disclosure relate to a sheet stacking apparatus, a post-processing apparatus, and an image forming system.

Related Art

Post-processing apparatuses that cause sheets of recording media sequentially conveyed at predetermined intervals when images are formed on the sheets to be aligned in a stacked state on a sheet ejection tray (a stacker) are known. Among such post-processing apparatuses, some have multiple sheet ejection modes, such as a sheet ejection mode in which sheets are ejected one by one for a process such as sorting, and a sheet bundle ejection mode typified by a staple mode in which sheets are ejected as a sheet bundle.

Such a post-processing apparatus includes an ejection roller that ejects a sheet to a sheet ejection tray, and an alignment device that aligns the sheet ejected on the ejection tray. In the post-processing apparatus, the alignment device contacts the sheet on the ejection tray to move the sheet in a direction opposite an ejection direction, so that an end of the sheet contacts a wall, and a position of the sheet is aligned. The sheet ejected to the ejection tray by the ejection roller slides down under its own weight in a direction opposite the ejection direction by inclination of the ejection tray, and moves to a position in which the sheet can contact the alignment device.

SUMMARY

In at least one embodiment of this disclosure, there is described an improved sheet stacking apparatus that includes an ejector, a stacker, a wall, and an upper surface detector. The ejector ejects a sheet, and the stacker stacks the sheet ejected from the ejector. The wall contacts a trailing end of the sheet ejected from the ejector in an ejection direction to align the sheet. The upper surface detector detects an upper surface on a trailing end side of the sheet stacked on the stacker in the ejection direction. When the sheet moves toward the wall, the upper surface detector moves from a home position in which the upper surface detector detects the upper surface of the sheet to a retracted position in which the upper surface detector does not contact the sheet moving toward the wall.

Further described is an improved post-processing apparatus that includes a sheet processing device that performs post-processing on a sheet on which an image is formed, and the sheet stacking apparatus described above.

Still further described is an improved image forming system that includes an image forming apparatus that forms an image on a sheet, and the sheet stacking apparatus described above.

Yet further described is an improved image forming system that includes an image forming apparatus that form an image on a sheet, and the post-processing apparatus described above.

BRIEF DESCRIPTION OF TRE DRAWINGS

The aforementioned and other aspects, features, and advantages of the present disclosure are better understood by reference to the following detailed description when considered in connection with the accompanying drawings, wherein.

Figure 1:
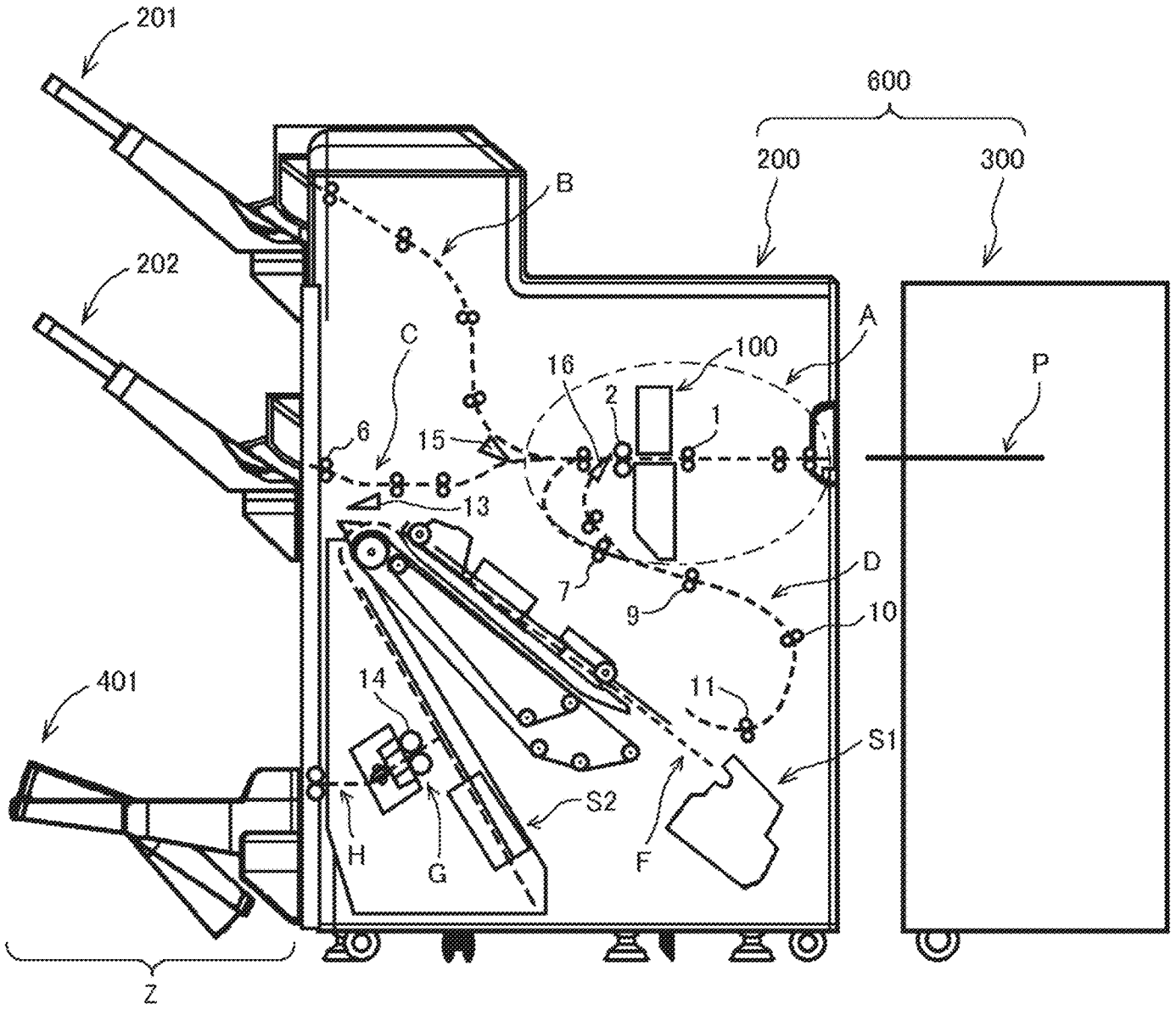
FIG. 1 is a schematic diagram illustrating an image forming system according to one embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic diagram illustrating an image forming system 600 according to one embodiment of the present disclosure. As illustrated in FIG. 1, the image forming system 600 includes a post-processing apparatus 200 as a sheet processing machine, and an image forming apparatus 300 that supplies a sheet as a sheet medium subsequent to image formation to the post-processing apparatus 200. The image forming apparatus 300 is, for example, a copier or a printer.

The image forming apparatus 300 of the present embodiment is an electrophotographic image forming apparatus including an image processing circuit, a photoconductor, an optical writing device, a developing device, a transfer device, and a fixing device that are not illustrated.

If the image forming apparatus 300 is a copier, the image processing circuit converts image data read by a scanner into printable image data, and outputs the converted image data to the optical writing device. Similarly, the image processing circuit converts image data input from an external device such as a personal computer into printable image data, and outputs the converted image data to the optical writing device.

The optical writing device performs optical writing on the photoconductor based on an image signal output from the image processing circuit to form an electrostatic latent image on a surface of the photoconductor. The electrostatic latent image formed on the surface of the photoconductor by the optical writing is developed with toner by the developing device. The transfer device transfers the toner image which is on the surface of the photoconductor and developed by the developing device to a sheet P. The fixing device fixes the toner image transferred to the sheet P on the sheet P.

The image forming apparatus 300 feeds the sheet P with the fixed toner image to the post-processing apparatus 200, and the post-processing apparatus 200 performs appropriate post-processing on the sheet P. The image forming apparatus 300 of the present embodiment employs the electrophotographic method as described above. However, any known image forming apparatus employing a method such as an inkjet method or a thermal transfer method can serve as the image forming apparatus 300. In such a case, the known image forming apparatus as the image forming apparatus 300 can be combined with the post-processing apparatus 200.

As illustrated in FIG. 1, the post-processing apparatus 200 is attached to a side of the image forming apparatus 300, and a sheet P ejected from the image forming apparatus 300 is guided to the post-processing apparatus 200.

The post-processing apparatus 200 of the present embodiment can perform a process such as punching (by a puncher 100), end portion binding (by an end portion stapler S1), saddle stitching (by a saddle stitching stapler S2), saddle folding (by a folding roller pair 14), and sorting on the sheet P.

The post-processing apparatus 200 has an inlet area A into which a sheet P ejected from the image forming apparatus 300 is first conveyed. In the inlet area A, a single-sheet post-processing device (the puncher 100 as a punching device in the present embodiment) is disposed to perform post-processing on the sheet P to pass through on a sheet basis.

A first ejection conveyance path B is formed above the inlet area A, and a second ejection conveyance path C is formed on a side (a left side in FIG. 1) of the inlet area A. The first ejection conveyance path B guides a sheet P to a shift tray 201, whereas the second ejection conveyance path C guides a sheet P to a shift tray 202. Moreover, a binding process conveyance path D is formed below the inlet area A of the post-processing apparatus 200. The binding process conveyance path D guides a sheet P to a binding process tray area F in which a process such as alignment and staple binding is performed.

The inlet area A includes a conveyance path that is provided upstream from the first ejection conveyance path B, the second ejection conveyance path C, and the binding process conveyance path D in a conveyance direction, and is a common conveyance path to all of sheets P delivered from the image forming apparatus 300 to the post-processing apparatus 200. In the inlet area A, an inlet sensor that detects passage of a sheet P received from the image forming apparatus 300 is disposed, and an inlet roller pair 1, the puncher 100, and a conveyance roller pair 2 are sequentially arranged downstream from the inlet sensor. Moreover, two bifurcating claws (a first bifurcating claw 15 and a second bifurcating claw 16) are arranged downstream from the conveyance roller pair 2 of the inlet area A.

Each of the first bifurcating claw 15 and the second bifurcating claw 16 is held in a state illustrated in FIG. 1 by an urging member such as a spring. That is, the first bifurcating claw 15 is urged such that a tip of the first bifurcating claw 15 faces downward, and the second bifurcating claw 16 is urged such that a tip of the second bifurcating claw 16 faces upward. Each of the first bifurcating claw 15 and the second bifurcating claw 16 is connected to a solenoid.

The tips of the first bifurcating claw 15 and the second bifurcating claw 16 are displaced from the states illustrated in FIG. 1 when the respective solenoids are turned on. Such displacement can change a conveyance path of the sheet P to pass a position in which each of the bifurcating claws 15 and 16 is arranged.

In the post-processing apparatus 200, activation of the solenoids of the first bifurcating claw 15 and the second bifurcating claw 16 are switched, so that the conveyance path of the sheet P having passed the inlet area A is distributed to the first ejection conveyance path B, the second ejection conveyance path C, or the binding process conveyance path D.

A shift tray ejection device as a stacking device including the shift trays 201 and 202 is disposed extremely downstream from the conveyance path of the sheet P to pass the inlet area A, the first ejection conveyance path B, and the second ejection conveyance path C in the post-processing apparatus 200. Moreover, the shift tray ejection device includes a tray shifter that reciprocates the shift trays 201 and 202 in a direction (a sheet width direction) perpendicular to a conveyance direction of the sheet P, and a tray mover that moves the shift trays 201 and 202 in a vertical direction.

In the binding process conveyance path D, a first roller pair 7, a sheet guide claw, a pre-stack sensor, a second roller pair 9, and a third roller pair 10 are arranged from an upstream side in the conveyance direction.

As illustrated in FIG. 1, the binding process conveyance path D has a curved portion arranged downstream from the third roller pair 10. A curve entrance sheet detection sensor is disposed at the entrance of the curve portion to detect the presence or absence of the passage of the sheet P in the entrance of the curve portion. A delivery roller pair 11 is disposed at the exit of the curved portion. The delivery roller pair 11 delivers the sheet P having passed the binding process conveyance path D to the binding process tray area F.

In the post-processing apparatus 200, while a binding process is being performed in the binding process tray area F, the binding process tray area F cannot receive a next sheet P. Herein, sheet delivery from the image forming apparatus 300 to the post-processing apparatus 200 may be stopped while a binding process is being performed in the binding process tray area F such that a new sheet P is not supplied to the binding process tray area F. However, such stoppage degrades productivity of the entire image forming system 600.

Accordingly, the post-processing apparatus 200 performs a pre-stack process to make time for a binding process while maintaining productivity of the entire image forming system 600. In the pre-stack process, sheets P are temporarily held up, and then a plurality of sheets P is simultaneously conveyed to the binding process tray area F, so that substantial time is gained.

The sheets P guided to the binding process tray area F via the inlet area A and the binding process conveyance path D undergo post-processing such as alignment and stapling in the binding process tray area F. Then, the sheets P are distributed to a conveyance path heading for the shift tray 202 or a conveyance path heading for a sheet stacking tray 401 in a saddle stitching stacking tray area Z by a sheet bundle bifurcating guide 13.

If the sheets P are distributed to the conveyance path heading for the shift tray 202, the sheets P are guided to the vicinity provided upstream from an ejection sheet detection sensor inside the second ejection conveyance path C. Subsequently, the sheets P are ejected to the shift tray 202 by a sheet ejection roller pair 6 as similar to a sheet P to pass the second ejection conveyance path C.

On the other hand, if the sheets P are distributed to the conveyance path heading for the sheet stacking tray 401, the sheets P are delivered to a saddle stitching/folding process area G. In the saddle stitching/folding process area G, post-processing such as saddle folding is performed on the sheets P. The sheets P having undergone the post-processing such as saddle folding pass a post-saddle-folding conveyance path H, and is conveyed to the sheet stacking tray 401.

Application of the present disclosure is not limited to the image forming system 600 including the image forming apparatus 300 and the post-processing apparatus 200. The present disclosure can be applied to a sheet processing device of an image forming system including an image forming device that forms an image on a sheet P and the sheet processing device which performs a folding process on the sheet P.

Moreover, the present disclosure can even be applied to a sheet stacking apparatus instead of the post-processing apparatus 200. The sheet stacking apparatus is provided by removing a sheet processing device that performs a predetermined process (e.g., punching, end-binding, and folding) from the post-processing apparatus 200. The sheet stacking apparatus sorts and stacks ejected sheets on the shift trays 201 and 202.

Figure 2:
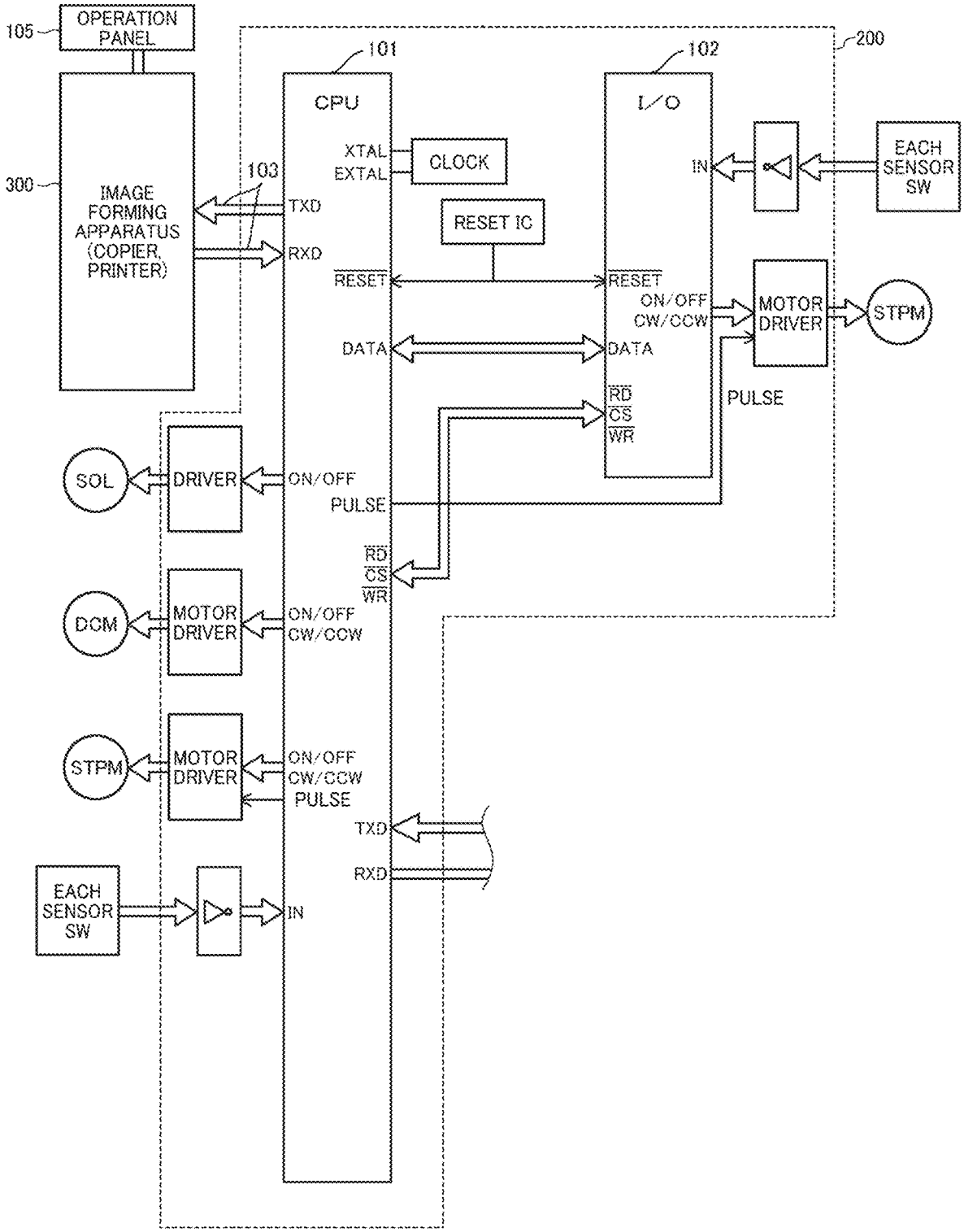
FIG. 2 is a block diagram illustrating a control configuration of the image forming system including a post-processing apparatus and an image forming apparatus.

FIG. 2 is a block diagram illustrating a control configuration of the image forming system 600 including the post-processing apparatus 200 and the image forming apparatus 300. The post-processing apparatus 200 includes a control circuit on which a micro-computer including a central processing unit (CPU) 101 and an input/output (I/O) interface 102 are mounted. The CPU 101 receives a signal from a CPU of the image forming apparatus 300, each switch on an operation panel 105, or each sensor (not illustrated) via a communication interface 103, and executes predetermined control based on the input signal. Moreover, the CPU 101 controls driving of a solenoid and a motor via a driver and a motor driver to acquire sensor information inside the apparatus from an interface. The CPU 101 also controls driving of the motor by using the motor driver via the I/O interface 102 according to a control target or a sensor to acquire sensor information from the sensor. The CPU 101 reads program code stored in a read only memory (ROM) to load the program into a random access memory (RAM), and executes such control based on a program defined by the program code while using the RAM as a work area and a data buffer.

Figure 3A:
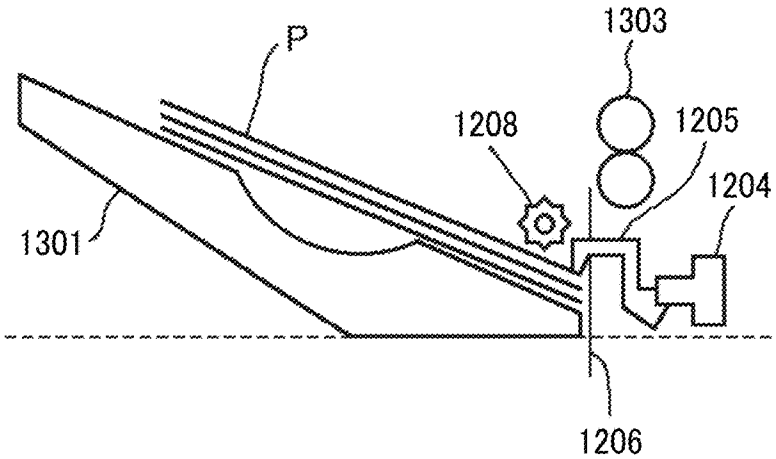
FIGS. 3A and 3B are schematic side views illustrating a comparative example of a sheet ejection tray device and sheet alignment.
Figure 3B:
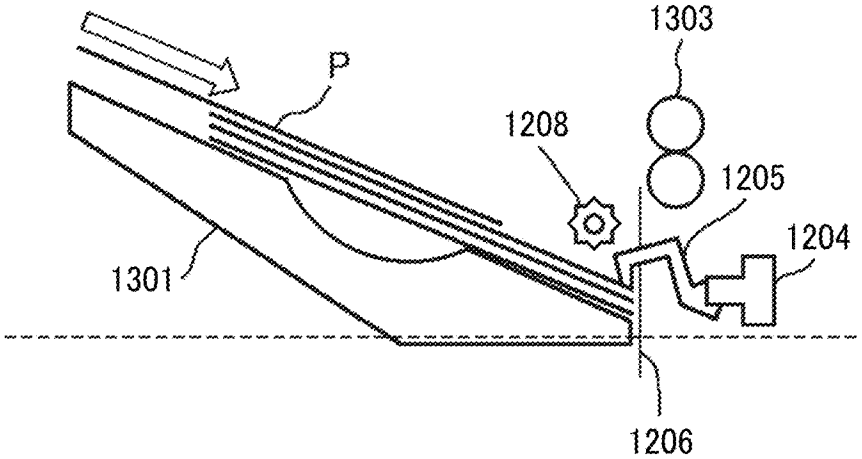

FIGS. 3A and 3B are schematic side views illustrating a comparative example of a sheet ejection tray device (sheet stacking apparatus) and a sheet alignment operation. As illustrated in FIG. 3A, when an upper surface detection feeler 1205 is in a home position (a standby position), a tip of the upper surface detection feeler 1205 protrudes toward a side near a shift tray 1301 from an end fence 1206, and contacts an upper surface of a stacked sheet to detect the upper surface. Moreover, when a return roller 1208 is in a home position (a standby position), the return roller 1208 protrudes toward the side near the shift tray 1301 from the end fence 1206 as a wall that is a reference to be used in alignment in a conveyance direction. An upper surface detection sensor 1204 is disposed in the back of the upper surface detection feeler 1205. A shielding plate disposed in a rear end of the upper surface detection feeler 1205 blocks light of the upper surface detection sensor 1204, so that an angle of the upper surface detection feeler 1205 is detected, and therefore an upper surface of the shift tray 1301 or the sheet is detected.

A sheet or a sheet bundle (hereinafter, a sheet bundle may be collectively called a sheet) to be ejected from a sheet ejection roller 1303 falls under its own weight to the shift tray 1301 as a stacking tray. Herein, since the sheet to be ejected is ejected at a certain speed to the shift tray 1301, the sheet lands in a position away from the end fence 1206 as illustrated in FIG. 3B and then slides under its own weight toward the end fence 1206 along inclination of the shift tray 1301. The sheet having fallen to the shift tray 1301 is aligned in a lateral direction perpendicular to a conveyance direction by a sheet ejection jogger of the sheet stacking apparatus.

Subsequently, the return roller 1208 contacts the upper surface of the sheet P to move the sheet P toward the end fence 1206, and causes an end portion of the sheet P to contact the end fence 1206 to adjust a position of the sheet P. Accordingly, the sheet P is aligned in the conveyance direction by using the end fence 1206 as the reference.

In general, when a sheet P is ejected, the shift tray 1301 is lowered to secure space for the ejected sheet P to be received. Herein, the upper surface detection feeler 1205 further lowers under its own weight to contact a sheet that is already stacked or the shift tray 1301.

An appropriate distance between the sheet P stacked on the shift tray 1301 and the return roller 1208 is maintained based on upper surface detection performed by the upper surface detection sensor 1204, and the shift tray 1301 is vertically moved according to such an upper surface detection state.

Desirably, the upper surface detection feeler 1205 constantly contacts the shift tray 1301 or the stacked sheet P to hold the shift tray 1301 in a suitable position. However, in such a desirable state, when alignment is to be performed, particularly, when a sheet P moving toward the end fence 1206 passes the upper surface detection feeler 1205, the sheet P and the upper surface detection feeler 1205 contact each other. Such contact may damage the sheet P or cause an alignment failure. In particular, when a stapled sheet bundle is to be aligned, a similar problem may occur due to a staple.

Moreover, when a thick stapled sheet bundle is ejected, the upper surface detection feeler 1205 can lower the shift tray 1301 or lower the shift tray 1301 so as to be separated from the stacked sheet P such that the upper surface detection feeler 1205 does not contact the thick stapled sheet bundle. However, since such an operation consumes time, productivity of the image forming system deteriorates. In addition, for example, if a sheet bundle includes two or three stitched-sheets, the upper surface detection feeler 1205 normally contacts an upper surface of the sheet bundle by its own weight even after the shift tray 1301 is lowered.

A sheet P to be ejected by the sheet ejection roller 1303 desirably falls to an area nearer to the end fence 1206 such that an ejection distance of the sheet P is shortened to prevent damage to the sheet P and degraded alignment accuracy. However, the sheet P to be ejected by the sheet ejection roller 1303 needs to be ejected to a certain distance away from the end fence 1206 and be moved along inclination of the shift tray 1301 such that the sheet P pushes away the upper surface detection feeler 1205 by its own weight to contact the end fence 1206. In particular, if a stapled sheet bundle is to be ejected, the sheet bundle needs to be ejected far enough to prevent the sheet bundle from contacting an element such as the return roller 1208. Such ejection causes alignment performance on the sheet bundle to be degraded more easily.

Figure 4A:
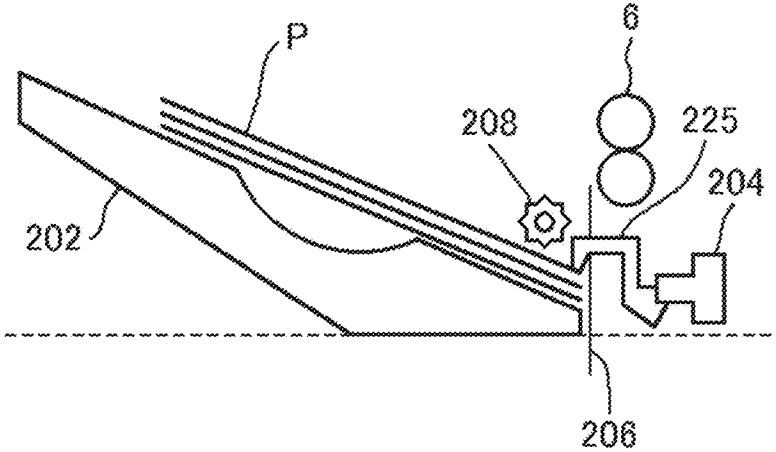
FIGS. 4A and 4B are schematic side views illustrating a sheet ejection tray device and sheet alignment according to the embodiment of the present disclosure.
Figure 4B:
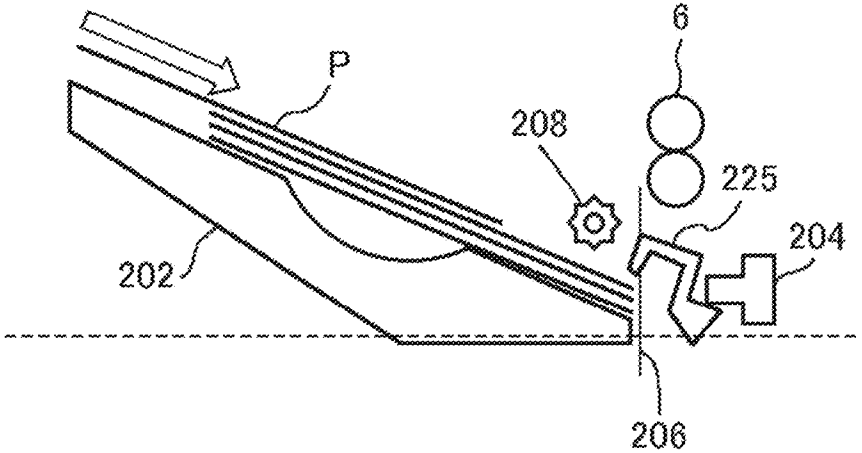

FIGS. 4A and 4B are schematic side views illustrating a sheet stacking apparatus (a sheet ejection tray device) and a sheet alignment operation according to the embodiment of the present disclosure. As illustrated in FIG. 4A, when an upper surface detection feeler 22.5 as an upper surface detector is in a home position (a standby position), a tip of the upper surface detection feeler 225 protrudes toward a side near the shift tray 202 from an end fence 206 as a wall and contacts an upper surface of a stacked sheet P to detect the upper surface. The end fence 206 is a reference to be used in alignment in a conveyance direction. When a return roller 208 is in a home position (a standby position), the return roller 208 protrudes toward the side near the shift tray 202 from the end fence 206. The upper surface detection sensor 204 is disposed in the back of the upper surface detection feeler 225. A shielding plate disposed in a rear end of the upper surface detection feeler 205 blocks light of the upper surface detection sensor 204, so that an angle of the upper surface detection feeler 205 is detected, and an upper surface of the shift tray 202 or the sheet is detected.

Examples of sheets to be ejected to the shift tray 202 include one sheet that is ejected via the second ejection conveyance path C (FIG. 1), and a sheet bundle that includes a plurality of stapled sheets and is ejected via the binding process conveyance path D.

As illustrated in FIG. 4A, the home positions (the standby positions) of the upper surface detection feeler 225 and the return roller 208 are substantially the same as the home positions of the upper surface detection feeler 1205 and the return roller 1208 in the comparative example illustrated in FIG. 3A. However, when an alignment operation is performed as illustrated in FIG. 4B, a position of the upper surface detection feeler 225 differs from a position of the upper surface detection feeler 1205 in the comparative example illustrated in FIG. 3B.

That is, according to the sheet stacking apparatus of the present embodiment, when a sheet P is moved toward the end fence 206, particularly, before a sheet P is completely ejected from the sheet ejection roller pair 6, the upper surface detection feeler 225 is moved from the home position in which the upper surface detection feeler 225 detects an upper surface of the sheet P to a retracted position in which the upper surface detection feeler 225 does not contact the sheet P moving toward the end fence 206. The sheet stacking apparatus includes the sheet ejection roller pair 6 as an ejector that ejects a sheet P, a shift tray 202 as a stacker on which the sheet P ejected from the sheet ejection roller pair 6 is stacked, the end fence 206 as a wall that causes a trailing end of the sheet P ejected from the sheet ejection roller pair 6 in an ejection direction to contact the wall to align the sheet P, and the upper surface detection feeler 225 as an upper surface detector that detects an upper surface on the trailing end side of the sheet P stacked on the shift tray 202 in the ejection direction.

Subsequently, the sheet P ejected from the sheet ejection roller pair 6 falls under its own weight to the shift tray 202. However, the sheet P does not contact the upper surface detection feeler 225 in the retracted position while falling under its own weight. In addition, the sheet P having fallen under its own weight can move on the shift tray 202 and reaches the end fence 206 without receiving an unnecessary drag from the upper surface detection feeler 225. Accordingly, a linear speed of ejection of the sheet P can be reduced, and the sheet P can be ejected to a position nearer to the end fence 206. Hence, an issue such as the sheet damage and the alignment failure mentioned above can be prevented.

Moreover, the sheet stacking apparatus includes the return roller 208 as an alignment device that contacts a sheet P stacked on the shift tray 202 and causes a trailing end of the sheet P in an ejection direction to contact the end fence 206 to align the sheet P. Thus, instead of movement of the sheet P by its own weight, the rotation-contact of the return roller 208 enables the sheet P to contact the end fence 206 to align the sheet P, thereby enhancing alignment accuracy.

As illustrated in FIG. 4A, the upper surface detection feeler 225 is positioned below the sheet ejection roller pair 6. Thus, the upper surface detection feeler 225 can be arranged in a suitable position for retraction.

Moreover, the sheet stacking apparatus includes a drive source (a drive motor 221) for retraction of the upper surface detection feeler 225, and a separate drive source (a drive motor 231) for retraction of the return roller 208. These drive sources may serve as a same drive source, and the upper surface detection feeler 225 may be retracted in response to retraction of the return roller 208. In such a case, however, the upper surface detection feeler 225 is retracted not only when a stapled sheet bundle is ejected, but also when one sheet (flat sheet) is ejected. In the present embodiment, only when a stapled sheet bundle is ejected, the upper surface detection feeler 225 can be minimally retracted, and the shift tray 202 can be maintained at a certain height The shift tray 202 can be reciprocated in a sheet width direction perpendicular to the conveyance direction. Such a shift operation enables a sheet to be moved by a certain amount and stacked on the shift tray 202, so that the sheet can be sorted.

Figure 5:
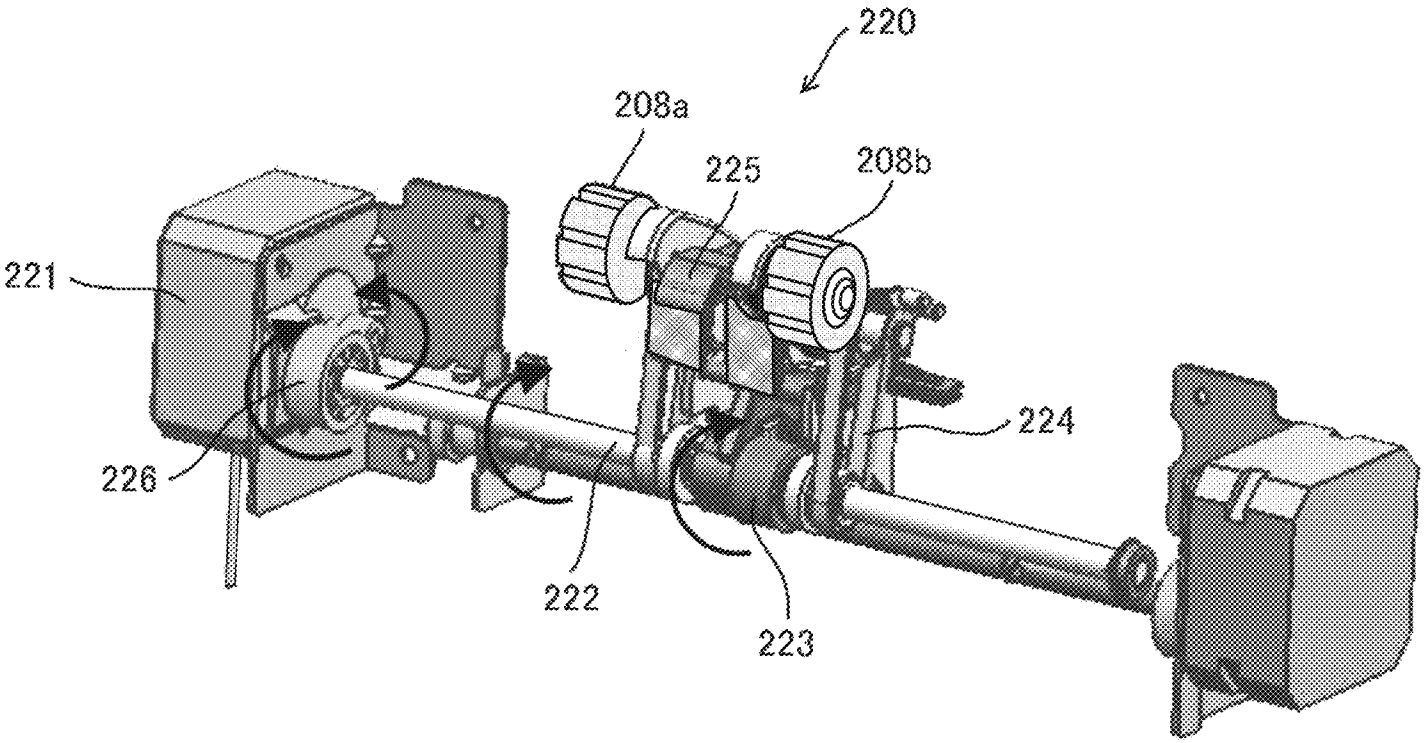
FIG. 5 is a perspective view illustrating a feeler retraction mechanism for retraction of an upper surface detection feeler.

FIG. 5 is a perspective view illustrating a feeler retraction mechanism 220 for retraction of the upper surface detection feeler 225. The feeler retraction mechanism 220 includes the upper surface detection feeler 225, the drive motor 221 for retraction of the upper surface detection feeler 225, a drive shaft 222 of the drive motor 221, and a cam 223. The upper surface detection feeler 225 arranged on the drive shaft 222 contacts the cam 223.

The drive shaft 222 is disposed in a predetermined position of a frame. The drive shaft 222 is rotatably supported via a bearing, and has an end portion to which a drive pulley 226 is attached. The drive pulley 226 receives a driving force transmitted from the drive motor 221 fixed to the frame. The cam 223 is attached to a substantially middle portion of the drive shaft 222, and the upper surface detection feeler 225 is in contact with the cam 223. Accordingly, when the cam 223 is rotated by operation of the drive motor 221, the upper surface detection feeler 225 swings between the retracted position and a retraction release position (the home position) by irregularities on an outer circumferential surface of the cam 223.

The drive shaft 222 is wound with a belt 224, and the belt 224 is connected to the return roller 208 including return rollers 208*a* and 208*b* (hereinafter, the return roller 208 is also referred to as the return rollers 208*a* and 208*b*). Thus, the return rollers 208*a* and 208*b* are rotated by the drive motor 221. That is, rotation of the return rollers 208*a* and 208*b* and retraction of the upper surface detection feeler 225 are performed by the same drive source which is the drive motor 221. Hence, size-reduction, power-saving, and cost reduction of the device can be achieved.

The cam 223 includes a one-way clutch. When the drive motor 221 rotates clockwise, the return rollers 208*a* and 208*b* are rotated with rotation of the drive shaft 222 and the belt 224. Meanwhile, the cam 223 is not rotated, and the upper surface detection feeler 225 remains in the position without swinging. On the other hand, when the drive motor 221 rotates counterclockwise, in addition to rotation of the return rollers 208*a* and 208*b*, the cam 223 is rotated, and the upper surface detection feeler 225 swings and moves to the retracted position.

Since the return rollers 208*a* and 208*b* are rotators, sheet alignment can be performed with respect to various types, thickness, sizes of sheets as well as the various number of sheet bundles. Each of the return rollers 208*a* and 208*b* is made of a material such as sponge and resin.

Figure 6A:
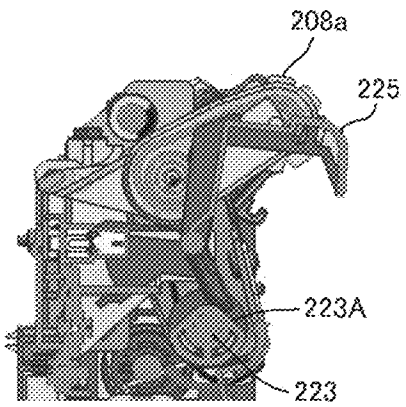
FIGS. 6A through 6H are partial side views illustrating retraction of the upper surface detection feeler.
Figure 6B:
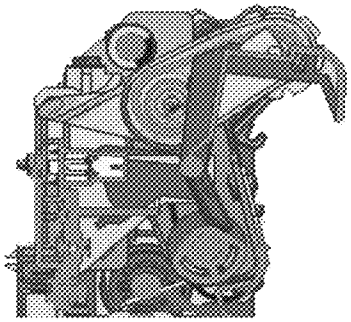
Figure 6C:
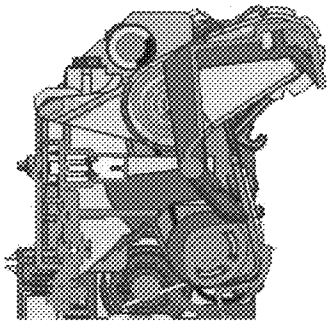
Figure 6D:
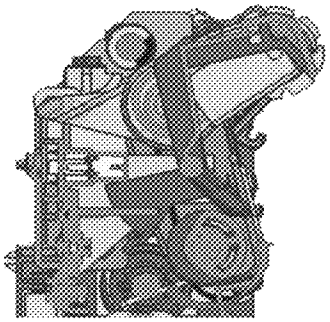
Figure 6E:
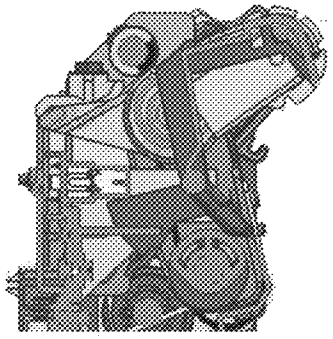
Figure 6F:
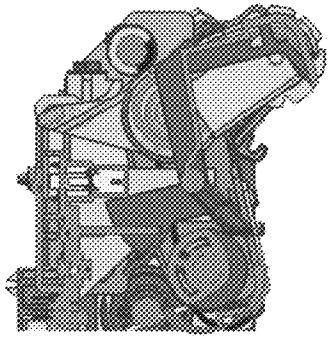
Figure 6G:
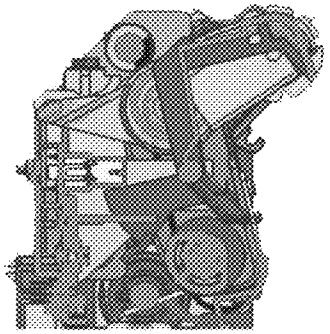

FIGS. 6A through 6H are partial side views illustrating retraction of the upper surface detection feeler 225. FIG. 6A illustrates an initial position in which the upper surface detection feeler 225 is in contact with a cam portion 223A of the cam 223. When the retraction of the upper surface detection feeler 225 is started (FIG. 6B), the cam 223 rotates counterclockwise, and a contact position between the upper surface detection feeler 225 and the cam portion 223A of the cam 223 changes. Accordingly, the upper surface detection feeler 225 starts retracted backward (FIG. 6C). The cam 223 further rotates counterclockwise (FIG. 6D). When the cam 223 rotates by 180 degrees (FIG. 6E) from the initial position, the retraction of the upper surface detection feeler 225 is completed, and the upper surface detection feeler 225 finishes moving to a retracted position. When the cam 223 further rotates counterclockwise, retraction release of the upper surface detection feeler 225 is started (FIG. 6F), and the upper surface detection feeler 225 starts moving frontward (FIG. 6G). Then, when the cam 223 rotates from the retracted position (FIG. 6E) by 180 degrees, the retraction release of the upper surface detection feeler 225 is completed (FIG. 6H), and the upper surface detection feeler 225 moves to a retraction release position (a home position). Herein, the retraction release position (the home position) is substantially the same as the initial position. The return rollers 208*a* and 208*b* are not moved.

Figure 6H:
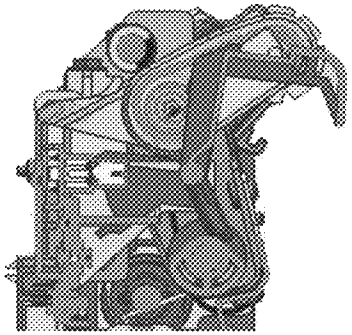

Accordingly, each of the retraction and the retraction release of the upper surface detection feeler 225 is executed by the rotation of the cam 223 by 180 degrees (or 180+α degrees). In the present embodiment, the upper surface detection feeler 225 is retained in only two positions, the retracted position (FIG. 6E) or the retraction release position (the home position) (FIG. 6H). In a case where the upper surface detection feeler 225 moves between three positions in response to three positions in which the return roller 208 is to be held, there are three positions (heights) for the shift tray 202. However, the arrangement of the separate drive sources for retraction of the upper surface detection feeler 225 and retraction of the return roller 208 enables an upper surface of the shift tray 202 to constantly remain in a certain position, and the upper surface detection feeler 225 to perform detection in a position substantially the same as the position in the comparative example. When the retraction is finished, the cam 223 is rotated clockwise, the opposite of the direction illustrated in FIGS. 6A through 6H to rotate only the return rollers 208*a* and 208*b*.

Figure 7:
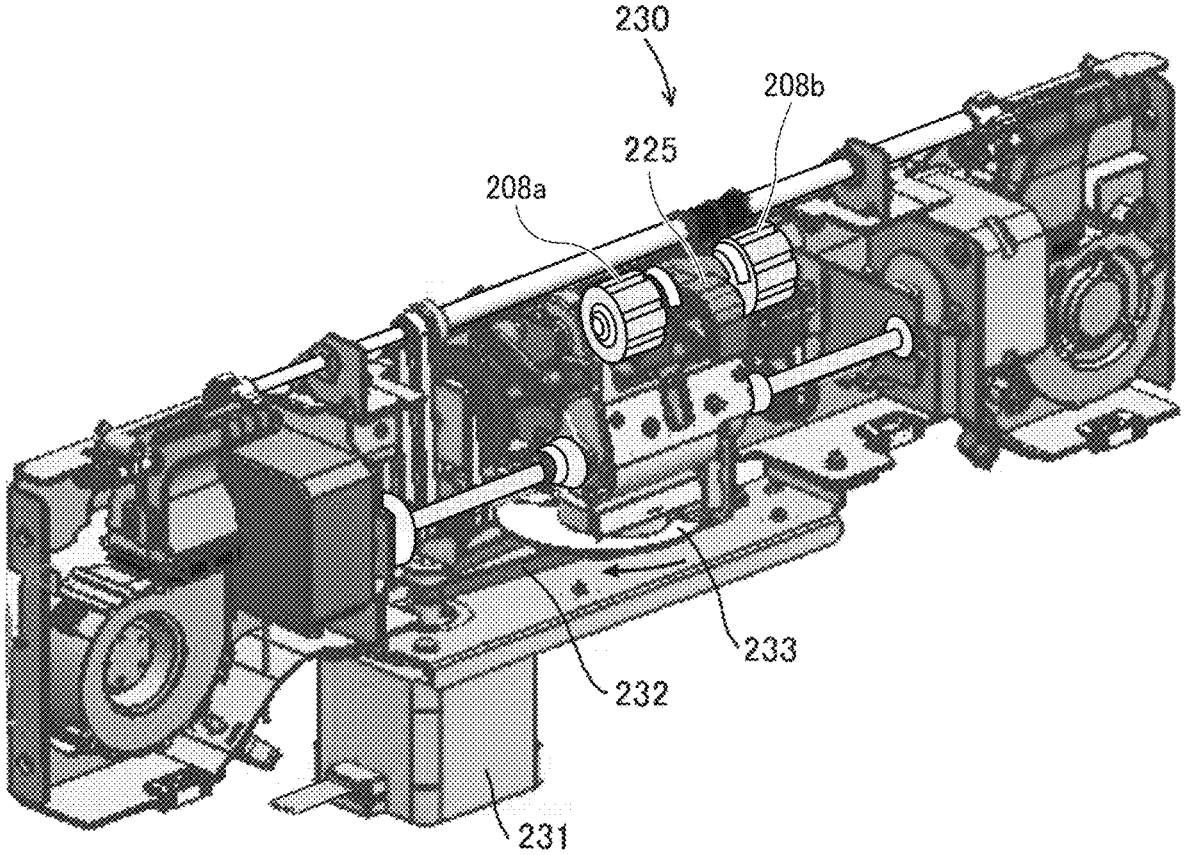
FIG. 7 is a diagram illustrating a return roller retraction mechanism for retraction of return rollers.

FIG. 7 is a diagram illustrating a return roller retraction mechanism 230 for retraction of the return rollers 208*a* and 208*b*. The return roller retraction mechanism 230 includes the return rollers 208*a* and 208*b* as an alignment device, the drive motor 231 for retraction of the return rollers 208*a* and 208*b*, a belt 232 stretched by a rotation shaft of the drive motor 231, a return roller retraction cam 233 coupled to the belt 232, and a spring. The return rollers 208*a* and 208*b* contact a sheet P ejected to the shift tray 202, and moves the sheet P to align the sheet P. Each of the return rollers 208*a* and 208*b* is constantly urged in a direction of the return roller retraction cam 233 by the spring. When rotation of the drive motor 231 is transmitted to the belt 232, the return roller retraction cam 233 coupled to the belt 232 also rotates. Then, a diameter of the return roller retraction cam 233 changes, and the return rollers 208*a* and 208*b* contacted against the return roller retraction cam 233 by the spring move between three positions, a retracted position, a home position, and a return position, depending on a contact position.

Figure 8A:
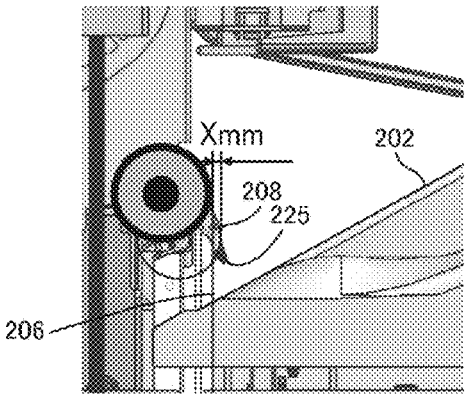
FIGS. 8A through 8F are schematic side views illustrating positions of the return rollers.
Figure 8B:
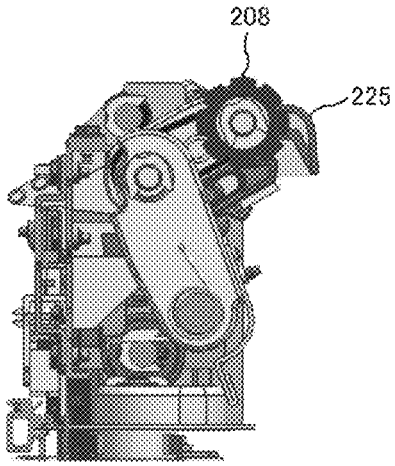
Figure 8C:
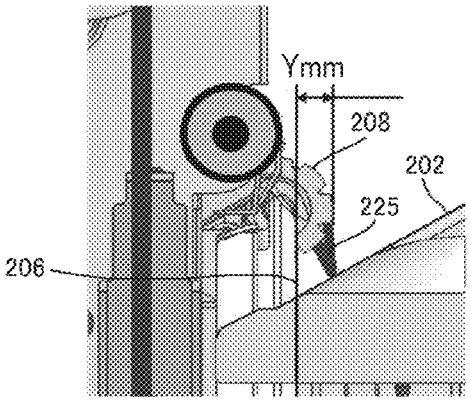
Figure 8D:
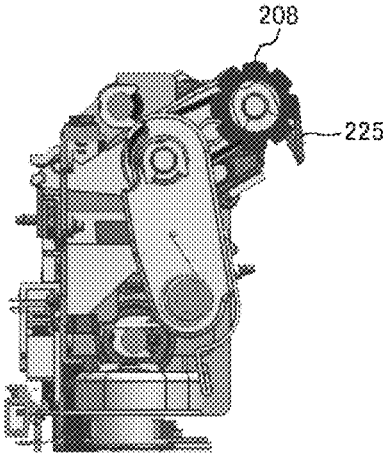
Figure 8E:
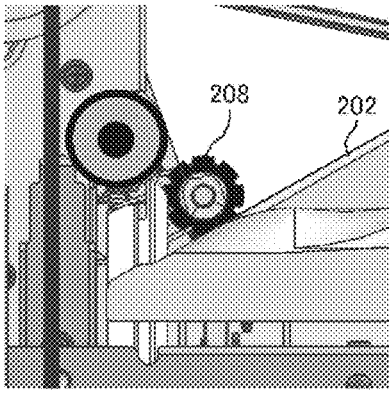
Figure 8F:
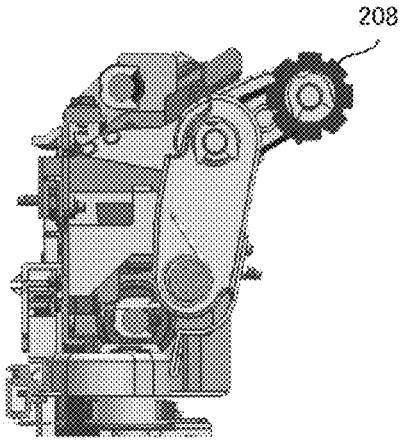

FIGS. 8A through 8F are schematic side views illustrating the three positions of the return rollers 208*a* and 208*b*. FIGS. 8A and 8B illustrate the retracted positions of the return rollers 208*a* and 208*b*. FIGS. 8C and 8D illustrate the home positions (standby positions) of the return rollers 208*a* and 208*b*. FIGS. 8E and 8F illustrate the return positions of the return rollers 208*a* and 208*b*. In the retracted positions illustrated in FIGS. 8A and 8B, the return rollers 208*a* and 208*b* protrude from the end fence 206 by only X mm. The return rollers 208*a* and 208*b* rotate even in the retracted positions. Accordingly, even when a sheet ejection speed is reduced to cause a stapled sheet bundle to fall to a position nearer to the end fence 206, the rotation of such protruding return rollers 208*a* and 208*b* scrapes off a trailing end of the sheet bundle, and thus concern about trailing end left is eliminated. Such an example case is not limited to the sheet bundle. When one sheet is to be ejected, the return rollers 208*a* and 208*b* can be moved to the retracted positions. In the retracted positions herein, the return rollers 208*a* and 208*b* and the upper surface detection feeler 225 are in the respective retracted positions.

In the home positions (the standby positions) illustrated in FIGS. 8C and 8D, the return rollers 208*a* and 208*b* protrude from the end fence 206 by only Y mm. Herein, a relation between X and Y is X<Y. In the home positions herein, the return rollers 208*a* and 208*b* and the upper surface detection feeler 225 are in the respective home positions. When one sheet is to be ejected, the return rollers 208*a* and 208*b* and the upper surface detection feeler 225 can be in the respective home positions as damage to the sheet caused by to a staple or degraded alignment accuracy due to a staple being caught does not occur.

In the return positions (the alignment positions) illustrated in FIGS. 8E and 8F, the return rollers 208*a* and 208*b* protrude frontward from the end fence 206 by greater than Y mm. In such positions, the return rollers 208*a* and 208*b* contact an upper surface of a sheet P to move the sheet P toward the end fence 206, and cause an end portion of the sheet P to contact the end fence 206 to adjust a position of the sheet P.

Thus, the return roller 208 moves between the return position, the home position, and the retracted position. In the return position, the return roller 208 protrudes toward the side near the shift tray 202 relative to the end fence 206, and can contact a sheet on the shift tray 202. In the home position, the return roller 208 is positioned on the side near the end fence 206 relative to the return position. In the retracted position, the return roller 208 is positioned on the side near the end fence 206 relative to the home position, and protrudes toward the side near the shift tray 202 relative to the end fence 206.

Figure 9A:
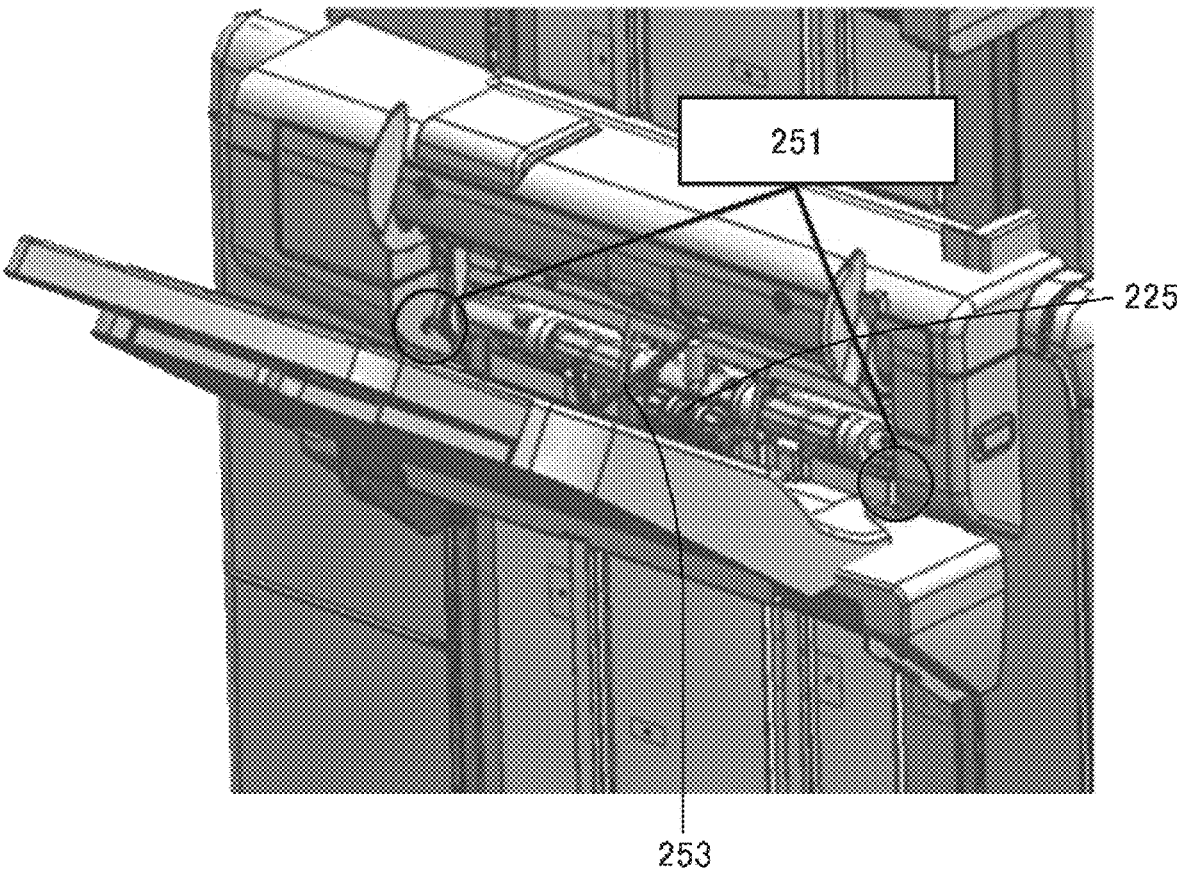
FIGS. 9A and 9B are diagrams illustrating an upper surface detection feeler according to another embodiment.
Figure 9B:
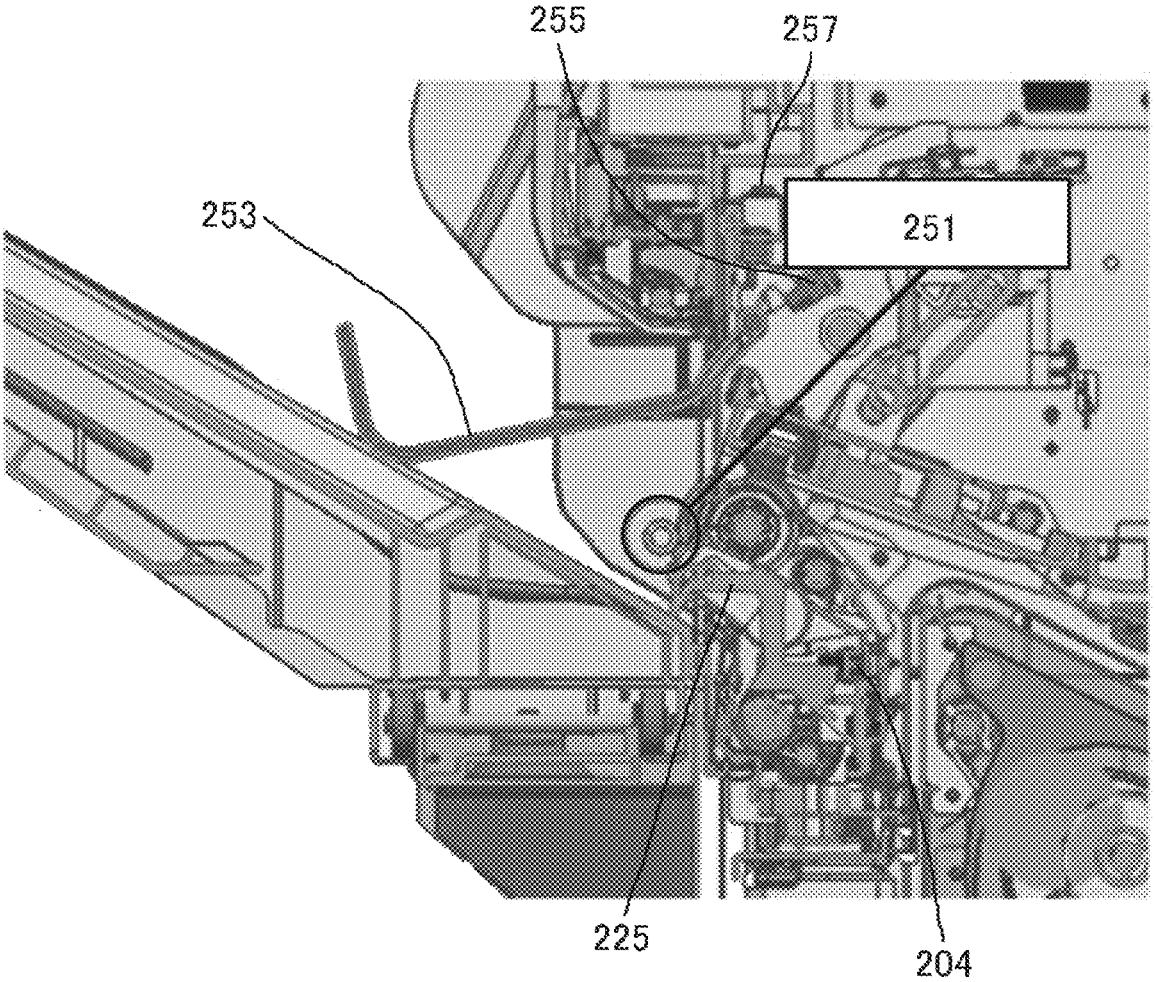

FIGS. 9A and 9B are diagrams illustrating an upper surface detection feeler according to another embodiment. FIG. 9A is a perspective view of upper surface detection feelers 225, 251, and 253. FIG. 9B is a sectional side view of the upper surface detection feeler 251. As illustrated in FIG. 9A, the upper surface detection feelers 225, 251, and 253 are disposed in a plurality of locations in a sheet width direction perpendicular to a conveyance direction. In particular, the upper surface detection feeler 225 is disposed in a substantially middle portion in the sheet width direction perpendicular to the sheet conveyance direction. The upper surface detection feelers 251 are disposed in two locations that are both end portions of a sheet ejection port. The upper surface detection feeler 253 is disposed in the same sheet width direction as the upper surface detection feeler 225. The upper surface detection feeler 253 contacts an upper surface on a leading end side of the sheet in the conveyance direction to detect the upper surface.

As illustrated in FIG. 9B, the upper surface detection feeler 253 has an L-shape, and a bent portion of the L-shape contacts the upper surface of the sheet. Herein, an angle of the upper surface detection feeler 253 is detected by sensors 255 and 257 disposed in the rear of the upper surface detection feeler 253, so that the upper surface of the sheet is detected, for example, a full state is also detected.

The upper surface detection feelers are disposed in a plurality of locations in a sheet width direction perpendicular to a conveyance direction. Such arrangement enables the upper surface detection feeler to be properly used depending on a thickness of a sheet to be ejected or a thickness of a sheet bundle, and thus alignment accuracy can be enhanced.

Figure 10:
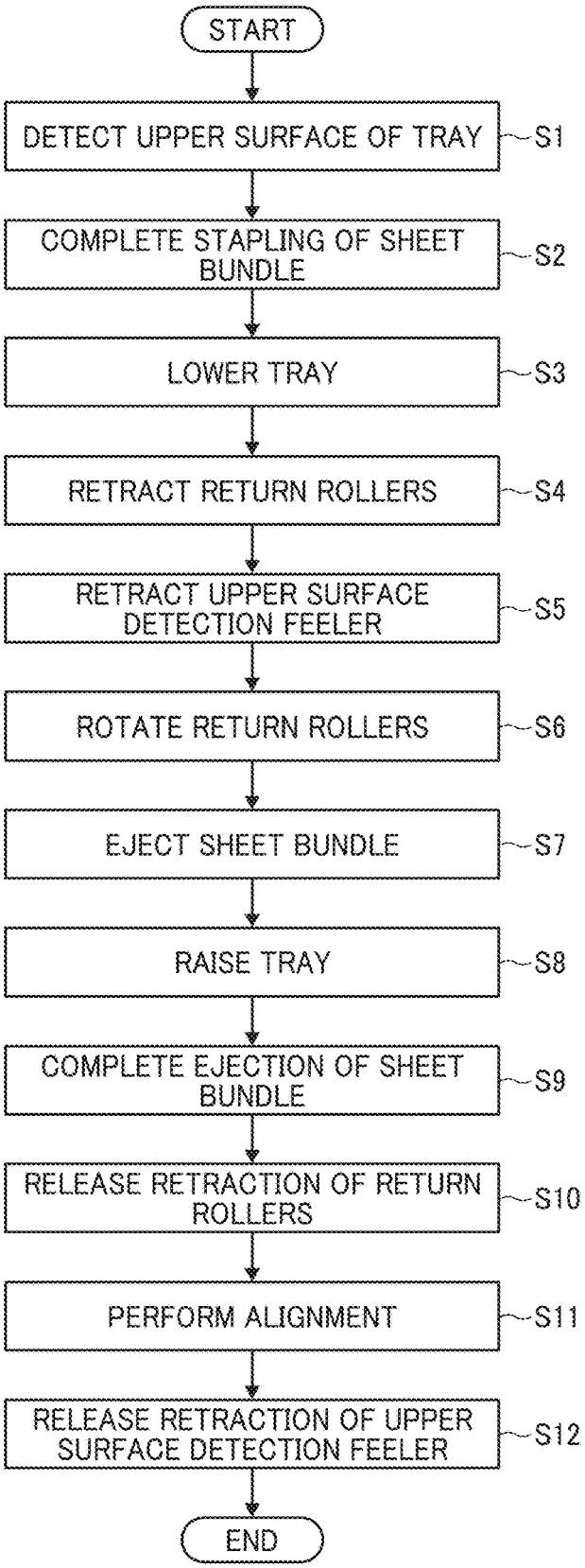
FIG. 10 is a flowchart of retraction of the upper surface detection feeler and the return rollers when a stapled sheet bundle is ejected.

FIG. 10 is a flowchart of retraction of the upper surface detection feeler 225 and the return rollers 208*a* and 208*b* when a stapled sheet bundle is ejected. In step S1, when printing/sheet ejection is started, the upper surface detection feeler 225 detects an upper surface of the shift tray 202. Thus, it is determined that the shift tray 202 is in a home position (e.g., see FIG. 4A). Subsequently, in step S2, stapling of a sheet bundle is completed. In step S3, the shift tray 202 is lowered to prepare for receiving a sheet bundle to be ejected. In step S4, the return rollers 208*a* and 208*b* are retracted. Then, in step S5, the upper surface detection feeler 225 is retracted. Alternatively, the upper surface detection feeler 225 may be retracted in response to the retraction of the return rollers 208*a* and 208*b*. Accordingly, unnecessary contact between the upper surface detection feeler 225 with the return rollers 208*a* and 208*b* and the sheet P can be prevented, and alignment accuracy can be enhanced. Alternatively, the upper surface detection feeler 225 may be retracted first, and the return rollers 208*a* and 208*b* may be retracted next.

Subsequently, in step S6, the return rollers 208*a* and 208*b* in the retracted positions are rotated. In step S7, the sheet bundle is ejected. Herein, even if the ejected sheet bundle contacts the return rollers 208*a* and 208*b* in the retracted positions, the sheet bundle is scraped off by the return rollers 208*a* and 208*b* being rotated and falls to the shift tray 202.

Subsequently, in step S8, the shift tray 202 starts rising. In step S9, a trailing end of the sheet bundle passes through the sheet ejection roller pair 6, and the ejection of the sheet bundle is completed. In step S10, the retraction of the return rollers 208*a* and 208*b* is released upon completion of the sheet bundle ejection. In step S11, the return rollers 208*a* and 208*b* are moved to return positions, and alignment is performed. That is, with the end fence 206 as a reference, the sheet bundle is aligned in a conveyance direction by the return rollers 208*a* and 208*b* which rotate in the return positions. In the alignment, the sheet bundle does not contact the upper surface detection feeler 225 in the retracted position. in step S12, the retraction of the upper surface detection feeler 225 is released. The upper surface detection feeler 225 contacts an upper surface of the sheet bundle on the tray with the rising of the tray (step S8) to detect the upper surface, and the printing/the sheet ejection ends.

The post-processing apparatus according to the embodiment of the present disclosure includes a sheet processing device that performs post-processing on a sheet on which an image is formed, and the aforementioned sheet stacking apparatus. Therefore, the post-processing apparatus with good alignment accuracy and good productivity can be provided.

The image forming system according to the embodiment of the present disclosure includes an image forming apparatus that forms an image on a sheet, and the aforementioned sheet stacking apparatus. The image forming system according to the embodiment of the present disclosure includes an image forming apparatus that forms an image on a sheet, and the aforementioned post-processing apparatus. Thus, an image forming system with good alignment accuracy and good productivity can be provided.

According to the embodiment of the present disclosure, therefore, a sheet P ejected from the sheet ejection roller pair 6 moves on the shift tray 202 along inclination of the shift tray 202, and is aligned at the end fence 206. However, when the sheet P passes the upper surface detection feeler 225, the upper surface detection feeler 225 is moved from a detection position to a retracted position. Hence, damage to the sheet P or alignment failure by the upper surface detection feeler 225 can be prevented. Particularly, when a stapled sheet bundle is ejected and aligned, a sheet ejection linear speed is reduced so that the sheet bundle is ejected to a side nearer to the end fence 206. Thus, damage to the sheet or alignment failure by a staple can be prevented.

The present disclosure has been described above with reference to specific embodiments but is not limited thereto. Various modifications and enhancements are possible without departing from scope of the disclosure. It is therefore to be understood that the present disclosure may be practiced otherwise than as specifically described herein. For example, elements and/or features of different illustrative embodiments may be combined with each other and/or substituted for each other within the scope of the present disclosure.

What is claimed is:

1. A sheet stacking apparatus comprising:

an ejector configured to eject a sheet;

a stacker configured to stack the sheet ejected from the ejector;

a wall configured to contact a trailing end of the sheet, ejected from the ejector in an ejection direction, to align the sheet;

an upper surface detector configured to detect an upper surface on a trailing end side of the sheet stacked on the stacker in the ejection direction, and configured to move from a home position, in which the upper surface detector is configured to contact and detect the upper surface of the sheet, to a retracted position in which the upper surface detector does not contact the sheet moving toward the wall when the sheet moves toward the wall, the movement of the upper surface detector from the home position to the retracted position occurring during ejection of the sheet from the ejector; and an alignment device configured to contact the sheet stacked on the stacker and configured to cause the trailing end of the sheet, in the ejection direction, to contact the wall to align the sheet, and wherein the alignment device is configured to move between:

a return position, in which the alignment device protrudes toward a side near the stacker relative to the wall and is contactable to a sheet on the stacker, a home position, in which the alignment device is positioned on a side near the wall relative to the return position, and a retracted position, in which the alignment device is on a side near the wall relative to the home position and protrudes toward a side near the stacker relative to the wall.

2. The sheet stacking apparatus of claim 1, wherein the upper surface detector is retained in only the home position or the retracted position.

3. The sheet stacking apparatus of claim 1, wherein the upper surface detector is configured to move to the retracted position upon a stapled sheet bundle being set to be ejected, and wherein the upper surface detector is configured to not move to the retracted position upon only one sheet being set to be ejected.

4. The sheet stacking apparatus of claim 1, wherein the alignment device is a rotator.

5. The sheet stacking apparatus of claim 4, wherein the alignment device is configured to rotate in the retracted position.

6. The sheet stacking apparatus of claim 4, further comprising one drive source configured to rotate the alignment device and configured to retract the upper surface detector.

7. The sheet stacking apparatus of claim 1, wherein the upper surface detector is retractable in response to retraction of the alignment device.

8. The sheet stacking apparatus of claim 1, wherein the upper surface detector is positionable below the ejector.

9. The sheet stacking apparatus of claim 1, wherein a plurality of upper surface detectors, including the upper surface detector, are arranged in a plurality of locations laterally across the sheet in a sheet width direction, perpendicular to the ejection direction.

10. A post-processing apparatus comprising:

a sheet processing device configured to perform post-processing on a sheet on which an image is formed; and the sheet stacking apparatus of claim 1.

11. An image forming system comprising:

an image forming apparatus configured to form an image on a sheet; and the sheet stacking apparatus of claim 1.

12. An image forming system comprising:

an image forming apparatus configured to form an image on a sheet; and the post-processing apparatus of claim 10.

13. The sheet stacking apparatus of claim 1, wherein the upper surface detector is configured to respectively move from the home position to the retracted position during ejection of each respective sheet, of a plurality of sheets to be stacked on the stacker, from the ejector.

14. The sheet stacking apparatus of claim 13, wherein the upper surface detector is configured to respectively move back to the home position, from the retracted position, subsequent to each respective sheet, of the plurality of sheets to be stacked on the stacker, contacting the wall.

15. A post-processing apparatus comprising:

a sheet processing device configured to perform post-processing on a sheet on which an image is formed; and the sheet stacking apparatus of claim 13.

16. An image forming system comprising:

an image forming apparatus configured to form an image on a sheet; and the sheet stacking apparatus of claim 13.

17. An image forming system comprising:

an image forming apparatus configured to form an image on a sheet; and the sheet stacking apparatus of claim 14.

* * * * *